US006747418B2

(12) United States Patent
Sowa

(10) Patent No.: US 6,747,418 B2
(45) Date of Patent: Jun. 8, 2004

(54) DEVICE AND METHOD FOR PREHEATING THE COIL ELECTRODES OF A FLUORESCENT LAMP

(75) Inventor: Wolfram Sowa, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/244,389

(22) Filed: Sep. 17, 2002

(65) Prior Publication Data

US 2003/0052620 A1 Mar. 20, 2003

(30) Foreign Application Priority Data

Sep. 17, 2001 (DE) ..... 101 45 766

(51) Int. Cl.[7] ..... H05B 37/02

(52) U.S. Cl. ..... 315/244; 315/224; 315/209 R; 315/291; 315/307

(58) Field of Search ..... 315/209 R, 291, 315/224, 219, 227 R, 307, DIG. 4, 244, 308, 247

(56) References Cited

U.S. PATENT DOCUMENTS

| | | | | |
|---|---|---|---|---|
| 5,122,712 A | | 6/1992 | Hirschmann | 315/106 |
| 5,493,181 A | | 2/1996 | Shackle et al. | 315/241 R |
| 5,825,136 A | * | 10/1998 | Rudolph | 315/291 |
| 5,854,538 A | | 12/1998 | Krummel | 315/105 |
| 5,880,562 A | * | 3/1999 | Nakagawa et al. | 315/224 |
| 6,194,840 B1 | * | 2/2001 | Chang | 315/209 R |
| 6,252,357 B1 | * | 6/2001 | Tanaka et al. | 315/209 R |
| 6,281,636 B1 | * | 8/2001 | Okutsu et al. | 315/209 R |
| 6,683,418 B2 | * | 1/2004 | Shoji et al. | 315/224 |

FOREIGN PATENT DOCUMENTS

| | | |
|---|---|---|
| EP | 0358502 | 3/1990 |
| EP | 0689373 | 12/1995 |

* cited by examiner

*Primary Examiner*—Don Wong
*Assistant Examiner*—Jimmy T. Vu

(57) ABSTRACT

The present invention relates to a device for preheating the two coil electrodes (W1, W2) of a fluorescent lamp (La) comprising an AC voltage source (10), a resonance capacitor $C_R$, which is arranged serially between the two coil electrodes (W1, W2), a first inductance (L1), which is coupled between the AC voltage source (10) and one of the two coil electrodes (W1, W2), and a second inductance (L2), which is connected to a point between the AC voltage source (10) and the coil electrode (W1) coupled thereto, the second inductance (L2) being coupled to the first inductance (L1) in such a way that a current flow ($I_{L2}$) through the second inductance (L2) leads to a reduction of the magnetization of the first inductance (L1). It furthermore relates to a corresponding method.

6 Claims, 1 Drawing Sheet

DEVICE AND METHOD FOR PREHEATING THE COIL ELECTRODES OF A FLUORESCENT LAMP

TECHNICAL FIELD

The present invention relates to a device for preheating the two coil electrodes of a fluorescent lamp comprising an AC voltage source, a resonance capacitor, which is arranged serially between the two coil electrodes, and a first inductance, which is coupled between the AC voltage source and one of the two coil electrodes. It additionally relates to a method for preheating the two coil electrodes of a fluorescent lamp.

BACKGROUND ART

In order to explain the problems on which the invention is based, FIG. 1 illustrates a preheating device of the generic type, known from the prior art. An AC voltage source 10 is formed from a DC voltage source U, two switches S1, S2 and a coupling capacitor $C_K$. The two coils W1, W2 of a fluorescent lamp La, in particular a low-pressure fluorescent lamp, are connected in series into the output circuit of an electronic ballast (not illustrated) which comprises an inductance L1 and also a resonance capacitor $C_R$. This circuit provides a very simple method of providing heating of the coils W1, W2 before the ignition of the lamp La.

In the case of this circuit, preheating current $I_V$ and preheating voltage $U_V$ are related to the inductance L1 and the resonance capacitor $C_R$ as follows:

$$\sqrt{\frac{LI}{C_R}} - \frac{U_v}{I_v}$$

Accordingly, the voltage $U_v$ across the lamp La during preheating and the preheating current $I_v$ cannot be chosen independently of one another given predetermined values for the inductance L1 and the resonance capacitor $C_R$. In the case of unfavorable lamp data or a lack of degrees of freedom in the design of the electrical ballast, it is possible, therefore, that adequate coil preheating will not be able to be obtained at the maximum permissible voltage $U_v$ across the lamp La.

DISCLOSURE OF THE INVENTION

The object of the present invention therefore consists in enabling preheating which suffices for the ignition of the lamp even in the case of unfavorable lamp data or a lack of degrees of freedom in the design of the electrical ballast.

This object is achieved by virtue of the fact that the device of the generic type furthermore comprises a second inductance, which is connected to a point between the AC voltage source and the coil electrode coupled thereto, the second inductance being coupled to the first inductance in such a way that a current flow through the second inductance leads to a reduction of the magnetization of the first inductance.

This measure makes it possible to realize intensified coil preheating which manages with a minimum of additional components. The current through the first inductance L1, the so-called lamp inductor, is increased by connecting the second inductance, which is designed in particular as an auxiliary winding fitted on the lamp inductor, in a polarity such that the current flowing therein reduces the magnetization of the first inductance L1, that is to say effectively reduces the effective inductance. In accordance with the above formula, a reduction of the effective inductance corresponds to an increase in the preheating current. After preheating, the second inductance is switched out.

By virtue of the present invention, the fixed coupling between the lamp inductor L1 and the resonance capacitor $C_R$ is abandoned, so that a higher preheating current can be realized during preheating, on account of the smaller effective inductance, without the permissible maximum lamp voltage being exceeded.

In accordance with a second aspect of the present invention, the above object is also achieved by means of a method for preheating the two coil electrodes of a fluorescent lamp, using a preheating device having an AC voltage source, a resonance capacitor, which is arranged serially between the two coil electrodes, a first inductance, which is coupled between the AC voltage source and one of the two coil electrodes, and a second inductance, which is connected to a point between the AC voltage source and the coil electrode coupled thereto, which comprises the following steps:

firstly, the second inductance is coupled to the first inductance in such a way that a current flow through the second inductance leads to a reduction of the magnetization of the first inductance. Afterward, a current flow through the second inductance is effected during preheating and a current flow through the second inductance is prevented or the coupling between the first and second inductances is interrupted after preheating.

A particularly preferred embodiment comprises a control device by which the current flow through the second inductance or the coupling between the first and second inductances can be controlled. This control device is preferably realized as a switch arranged in series with he second inductance, or a PTC thermistor. For the case where the control device is realized as a switch, it is possible to provide a drive device which closes the switch during preheating and otherwise opens it. For the case where the control device is realized as a PTC thermistor, this driving is unnecessary since said PTC thermistor automatically undergoes transition to the high-impedance state at a specific temperature and thereby prevents a current flow through the second inductance.

The other connection of the second inductance is preferably connected to ground.

BRIEF DESCRIPTION OF THE DRAWINGS

An exemplary embodiment is described in more detail below with reference to the accompanying drawings, in which.

BEST MODE FOR CARRYING OUT THE INVENTION

Figure 1:
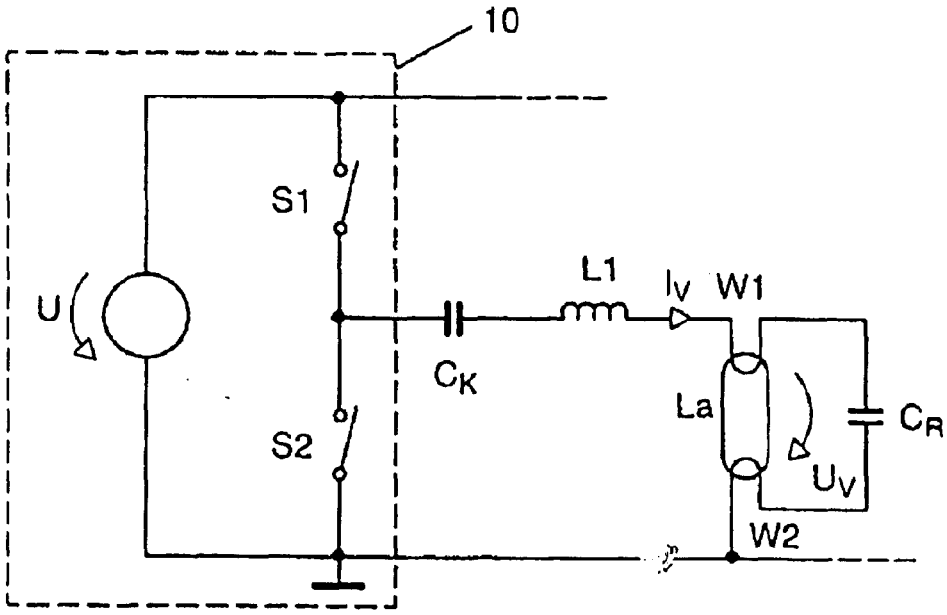
FIG. 1 Prior art
FIG. 1 shows a device for preheating the coil electrodes of a fluorescent lamp which is known from the prior art.
Figure 2:
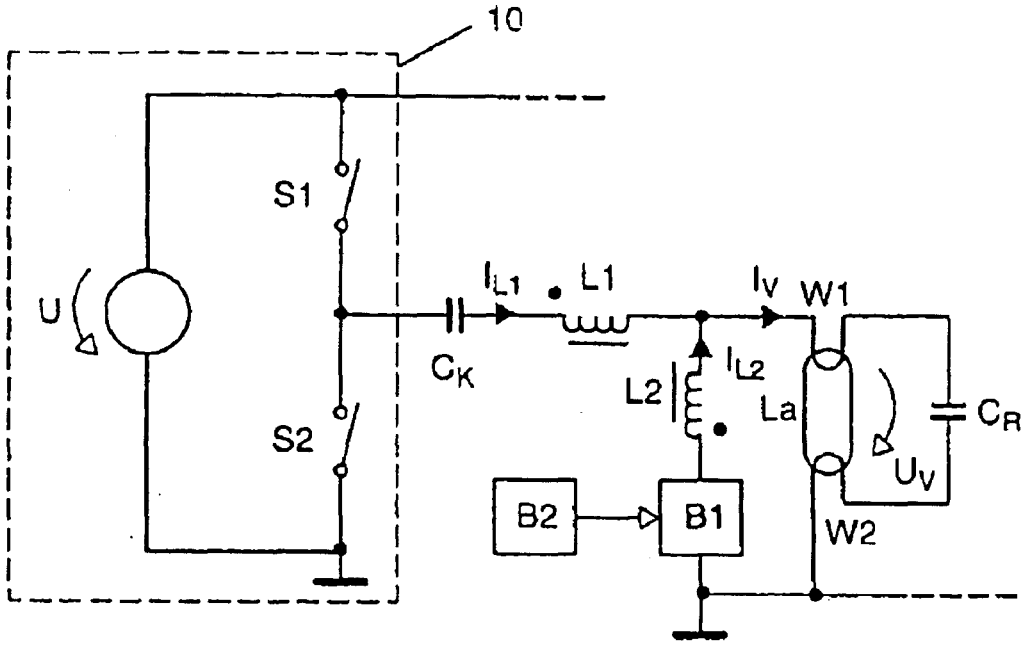
FIG. 2 shows an exemplary embodiment of a device according to the invention for preheating the coil electrodes of a fluorescent lamp.

FIG. 2 shows an exemplary embodiment of a device according to the invention for preheating the two coil electrodes W1, W2 of a fluorescent lamp La. Elements which are identical or act identically to those of FIG. 1 are identified by the same reference symbols. In the case of the device according to FIG. 2, however, the first inductance L1 is now coupled to the second inductance L2, to be precise in such a way that a current flow $I_{L2}$ through the second inductance L2 leads to a reduction of the magnetization of the first inductance L1. In the exemplary embodiment illustrated, the inductance L2 is connected between the inductance L1 and the lamp coil W1. However, a comparable effect can also be obtained if a connection of the inductance L2 is connected between the output of the AC voltage source 10 and the first inductance L1. A control device B1 is arranged in series with the second inductance L2, by which control device the coupling between first and second inductances L1, L2 can be controlled. By way of example, the control device B1 may be realized by a switch or a PTC thermistor, it being possible, of course, for further elements to be arranged in series with the switch, without this substantially impairing the idea of the invention. In the case of the realization by a switch, it is possible to provide a drive device B2 which drives the switch of the control device B1 such that it is only closed during preheating.

The first and second inductances L1, L2 are coupled to one another in such a way that the current flow $I_{L2}$ through the second inductance counteracts the current flow $I_{L1}$ through the first inductance, thereby producing a smaller effective inductance than in the case of the device known from the prior art, see FIG. 1.

Preferably, the inductance L1 is realized by the lamp inductor and the inductance L2 by an auxiliary winding fitted on the lamp inductor.

What is claimed is:

1. A device for preheating the two coil electrodes (W1, W2) of a fluorescent lamp (La), comprising;

an AC voltage source (10):

a resonance capacitor $C_R$, which is arranged serially between the two coil electrodes (W1, W2);

a first inductance (L1), which is counted between the AC voltage source (10) and one of the two coil electrodes (W1, W2);

characterized in that it furthermore comprises:

a second inductance (L2), which is connected to a point between the AC voltage source (10) and the coil electrode (W1) coupled thereto, the second inductance (L2) being coupled to the first inductance (L1) in such a way that a current flow ($I_{L2}$) through the second inductance (L2) leads to a reduction of the magnetization of the first inductance (L1) wherein the other connection of the second inductance (L2) is connected to ground.

2. A device for preheating first and second coil electrodes (W1, W2) of a fluorescent lamp (La) comprising:

an AC voltage source (10);

a first inductance (L1) coupled between the AC voltage source (10) and the first coil electrode (W1);

a resonance capacitor ($C_R$) coupled between the first and second coil electrodes (W1, W2);

a series circuit coupled between the first coil electrode (W1) and ground, the series circuit comprising:

a second inductance (L2) magnetically coupled to the first inductance (L1); and a control device (B1) for controlling a current flow ($I_{L2}$) through the second inductance (L2).

3. The device of claim 2, wherein the second inductance (L2) is coupled to the first inductance (L1) such that the current flow ($I_{L2}$) through the second inductance (L2) increases a current flow ($I_{L1}$) through the first inductance (L1).

4. The device as claimed in claim 2, characterized in that the control device (B1) is a PTC thermistor.

5. The device of claim 2, further comprising a drive device (B2) coupled to the control device (B1), wherein the drive device (B2) is operable:

(i) during preheating of the coil electrodes (W1, W2), to activate the control device (B1) and thereby effect a current flow ($I_{L2}$) through the second inductance (L2); and (ii) following completion of preheating of the coil electrodes (W1, W2), to deactivate the control device (B1) and thereby prevent a current flow ($I_{L2}$) through the second inductance (L2).

6. A method for preheating first and second coil electrodes (W1, W2) of a fluorescent lamp (La), using a preheating device having an AC voltage source (10), a first inductance (L1) coupled between the AC voltage source (10) and the first coil electrode (W1), a resonance capacitor ($C_R$) coupled between the first and second coil electrodes (W1, W2), and a series circuit coupled between the first coil electrode (W1) and ground, the series circuit comprising a second inductance (L2) and a control device (B1), the method comprising the steps of:

a) coupling the second inductance (L2) to the first inductance (L1) such that a current flow ($I_{L2}$) through the second inductance (L2) leads to a reduction in a current flow ($I_{L1}$) through the first inductance (L1);

b) effecting a current flow ($I_{L2}$) through the second inductance (L2) during preheating; and c) preventing a current flow ($I_{L2}$) through the second inductance (L2) after preheating.

* * * * *